US008270644B2

(12) United States Patent
Greiner

(10) Patent No.: US 8,270,644 B2
(45) Date of Patent: Sep. 18, 2012

(54) BINAURAL HEARING INSTRUMENT

(75) Inventor: Søren Bredahl Greiner, Smørum (DK)

(73) Assignee: Oticon A/S, Smorum (DK)

( * ) Notice: Subject to any disclaimer, the term of this patent is extended or adjusted under 35 U.S.C. 154(b) by 355 days.

(21) Appl. No.: 12/622,112

(22) Filed: Nov. 19, 2009

(65) Prior Publication Data

US 2010/0124347 A1 May 20, 2010

(30) Foreign Application Priority Data

Nov. 20, 2008 (EP) ..... 08105833
Nov. 11, 2009 (EP) ..... 09175668

(51) Int. Cl.
*H04R 25/00* (2006.01)

(52) U.S. Cl. ..... 381/314; 381/23.1

(58) Field of Classification Search ..... 381/314, 381/315, 23.1; 455/425
See application file for complete search history.

(56) References Cited

U.S. PATENT DOCUMENTS

| | | | | |
|---|---|---|---|---|
| 5,434,924 | A | 7/1995 | Jampolsky | |
| 5,721,783 | A | 2/1998 | Anderson | |
| 5,991,419 | A | 11/1999 | Brander | |
| 6,041,129 | A | 3/2000 | Adelman | |
| 2004/0037442 | A1 * | 2/2004 | Nielsen et al. | 381/315 |
| 2004/0057591 | A1 * | 3/2004 | Beck et al. | 381/315 |
| 2005/0255843 | A1 * | 11/2005 | Hilpisch et al. | 455/425 |
| 2007/0030988 | A1 * | 2/2007 | Bauml et al. | 381/315 |
| 2008/0089523 | A1 * | 4/2008 | Roeck | 381/23.1 |
| 2008/0240449 | A1 * | 10/2008 | Kornagel et al. | 381/23.1 |

FOREIGN PATENT DOCUMENTS

| | | | |
|---|---|---|---|
| EP | 0941014 | A2 | 9/1999 |
| JP | 2003/199076 | A | 7/2003 |
| WO | WO-02/07479 | A1 | 1/2002 |

* cited by examiner

*Primary Examiner* — Yuwen Pan
*Assistant Examiner* — Phan Le
(74) *Attorney, Agent, or Firm* — Birch, Stewart, Kolasch & Birch, LLP

(57) ABSTRACT

A binaural hearing instrument set is described in which algorithms are split into a server part and a thin-client part. The respective server part of the algorithm is located in a first hearing instrument unit, while the thin-client part is located in a second unit in the binaural hearing instrument set. This is advantageous in that it enables optimization of the usage of combined processing resources in the two units.

8 Claims, 1 Drawing Sheet

BINAURAL HEARING INSTRUMENT

TECHNICAL FIELD

The present invention relates to hearing instruments and specifically to a binaural hearing instrument set comprising processing circuitry, memory circuitry and communication circuitry.

BACKGROUND

Today hearing aids or hearing instruments have evolved into very small lightweight and powerful signal processing units. Naturally, this is mainly due to the very advanced development of electronic processing equipment, in terms of miniaturization, power usage etc., that has taken place during the last decades. Previous generations of hearing instruments were mainly of the analog type, whereas present day technology in this field mainly relate to digital processing units. Such units transform audio signals emanating from an audio input transducer into digital representation data that is processed in complex mathematical algorithms and transformed back into analog signals and output via audio output transducers to a user.

The transformations and the processing algorithms are realized by means of software programs that are stored in memory circuits and executed by processors. However, despite the very advanced development of processors and memory circuit technology, there are still limitations on how much processing power that can be configured in a hearing instrument. That is, presently the amount of memory that is available for software code and data storage in a hearing instrument is a limiting factor when deciding the complexity of an algorithm or the number of algorithms being able to run simultaneously in a hearing instrument.

Binaural hearing instruments are sets of two individual hearing instruments, configured to be arranged at a left ear and a right ear of a user. Such a hearing instrument set or pair can communicate wirelessly together while in use for exchanging data which provides it the ability to, e.g., synchronize states and algorithms. Typically, in present day binaural hearing instruments, each hearing instrument in a pair executes the same algorithms simultaneously.

Such solutions have a drawback in that each instrument in a binaural instrument pair need to be provided with as powerful processing capability as possible. A further drawback is a reduced battery life, since all processing circuitry parts that are required to execute the algorithms need to be simultaneously functional in both instruments. These drawbacks have been addressed in the prior art. For example, U.S. Pat. No. 5,991,419 describes a bilateral signal processing prosthesis where only one of the two units of the pair of units comprises a signal processor and sound signals are transmitted between the units via a wireless link. A drawback of this solution is that the circuitry in the unit with the signal processor requires substantially more space and power than the circuitry in the unit without the signal processor. A further drawback of this solution is that the unit without the signal processor is not able to execute the algorithms when it is disconnected from the unit with the signal processor.

SUMMARY

In order to improve on the prior art there is provided a binaural hearing instrument set that comprises a first unit and a second unit. Each of the units comprises processing circuitry, communication circuitry and memory circuitry. The processing circuitry and the memory circuitry are configured to execute at least a first data processing algorithm. The first data processing algorithm is configured such that it comprises software code that is configured to execute in a server mode and a client mode. The first unit comprises the software code that is configured to execute in the server mode, and the second unit comprises the software code that is configured to execute in the client mode, and the communication circuitry is configured to provide a communication channel between the software code that is configured to execute in the server mode in the first unit and the software code that is configured to execute in the client mode in the second unit. The processing circuitry and the memory circuitry are configured to execute a second data processing algorithm in addition to the first data processing algorithm. The second data processing algorithm is configured such that it comprises software code that is configured to execute in a server mode and a client mode. The first unit comprises the software code of the second algorithm that is executable in the client mode, and the second unit comprises the software code of the second algorithm that is executable in the server mode.

In other words, a binaural hearing instrument set is configured such that an algorithm is run in either server mode or client mode. The algorithm running in server mode in the first unit, e.g. a unit configured to be worn at a left ear of a user, is run in client mode in the second unit, e.g. a unit configured to be worn at a right ear, and vice versa. The algorithm running in server mode runs a computation which typically uses a lot of resources and communicates with the other unit running in the client mode. The client mode algorithm needs fewer resources not having to implement the algorithm in the same way as in the server mode. Therefore, as the client algorithm in the second unit uses fewer resources, it can thus run another algorithm in server mode that communicates with a corresponding other algorithm running in client mode in the first unit. This is advantageous in that it enables optimization of the usage of combined processing resources in the two units making up a binaural hearing instrument set. In particular, the resource usage may be optimized by configuring the hearing instrument set such that each unit executes each algorithm in either server mode or client mode.

Embodiments include those where the software code of the first unit that is executable in the server mode is configured to execute a major part of the data processing algorithm, and the software code of the second unit that is executable in the client mode is configured to execute a minor part of the data processing algorithm. In other words, the algorithm running in server mode may run the actual computations which typically use a lot of resources, while the client mode algorithm does not execute much of the actual computations.

Embodiments include those where the software code of the first unit that is executable in the server mode is configured such that it has a server code size, and the software code of the second unit that is executable in the client mode is configured such that it has a client code size that is smaller than the server code size. Such embodiments facilitate optimization of memory usage, since the algorithm running in server mode typically comprises a larger number of software instructions than the client version of the algorithm.

Embodiments include those where the software code of the first unit that is executable in the server mode is configured to utilize a first amount of memory during execution, and the software code of the second unit that is executable in the client mode is configured to utilize a second amount of memory during execution, the second amount of memory being smaller than the first amount of memory. Such embodiments may further facilitate optimization of memory usage, since the algorithm running in server mode typically makes use of larger memory storage than the client version of the algorithm.

Embodiments include those where the software code of the first unit that is executable in the server mode is configured to process data pertaining to the first unit and the second unit, and configured to receive data from the second unit and transmit processed data to the second unit, and the software code of the second unit that is executable in the client mode is configured to transmit data to the first unit and receive processed data from the first unit. In those embodiments, the first unit and the second unit comprising respective audio input transducers and respective audio output transducers, the software code of the first unit may be configured to receive audio input data from the input transducer in the first unit, process the audio data from the input transducer in the first unit and output processed audio data to the audio output transducer in the first unit. Furthermore, the software code of the first unit may in those embodiments be configured to receive audio data from the second unit, process the received audio data and transmit processed audio data to the second unit, and the software code of the second unit may in those embodiments be configured receive audio input data from the input transducer in the second unit, transmit the audio data from the input transducer in the second unit, receive processed audio data from the first unit, and output the processed audio data to the audio output transducer in the second unit.

In other words, the algorithm running in server mode in the first unit performs a major part of the necessary computations. It also receives essentially unprocessed data from input transducers in the second unit and sends results after processing back to the second unit, where the data is output via output transducers. The client part of the algorithm in the second unit simply receives the results from the server in the first unit and uses them directly, i.e. essentially without processing the data further, by outputting the data via output transducers.

Embodiments include those where the first and the second data processing algorithms are identical, the hearing instrument set is configured to selectively activate or deactivate execution of the first data processing algorithm and to deactivate execution of the second data processing algorithm in response to activating execution of the first data processing algorithm.

In other words, the hearing instrument set may dynamically switch between having the first unit or the second unit execute the server mode part of a particular computation. Such embodiments allow adaptation of the resource usage to different situations during use of the hearing instrument set. This is advantageous in that it enables further optimization of the usage of combined processing resources in the two units making up a binaural hearing instrument set.

Embodiments include those where the first unit is configured to activate execution of the first data processing algorithm in response to detecting a failure of the communication channel.

Such embodiments allow each of the first and second units to be used as a stand-alone hearing instrument.

Embodiments include those where the processing circuitry and the memory circuitry of the second unit are configured to execute a third data processing algorithm, the second unit is configured to selectively activate or deactivate execution of the third data processing algorithm and to transmit one or more status messages to the first unit, the status messages indicating the activation of the execution of the third data processing algorithm, and the first unit is configured to activate execution of the first data processing algorithm in response to the status messages.

In other words, the hearing instrument set may dynamically balance the resource usage between the first and the second unit when the need for data processing changes, e.g. when the user of the hearing instrument set enters a different acoustic environment.

Embodiments include those where the first unit is configured to reduce a clock frequency and/or a computation speed of the processing circuitry in the first unit in response to deactivating execution of the first data processing algorithm.

In other words, the hearing instrument set may dynamically reduce clock frequencies and/or computation speeds in circuitry or circuitry portions that execute the client mode part of computations. Such embodiments allow the hearing instrument set to reduce the total power consumption of the set further.

BRIEF DESCRIPTION OF THE DRAWINGS

An embodiment will now be described with reference to the attached drawings, where.

DETAILED DESCRIPTION OF EMBODIMENTS

Figure 1A:
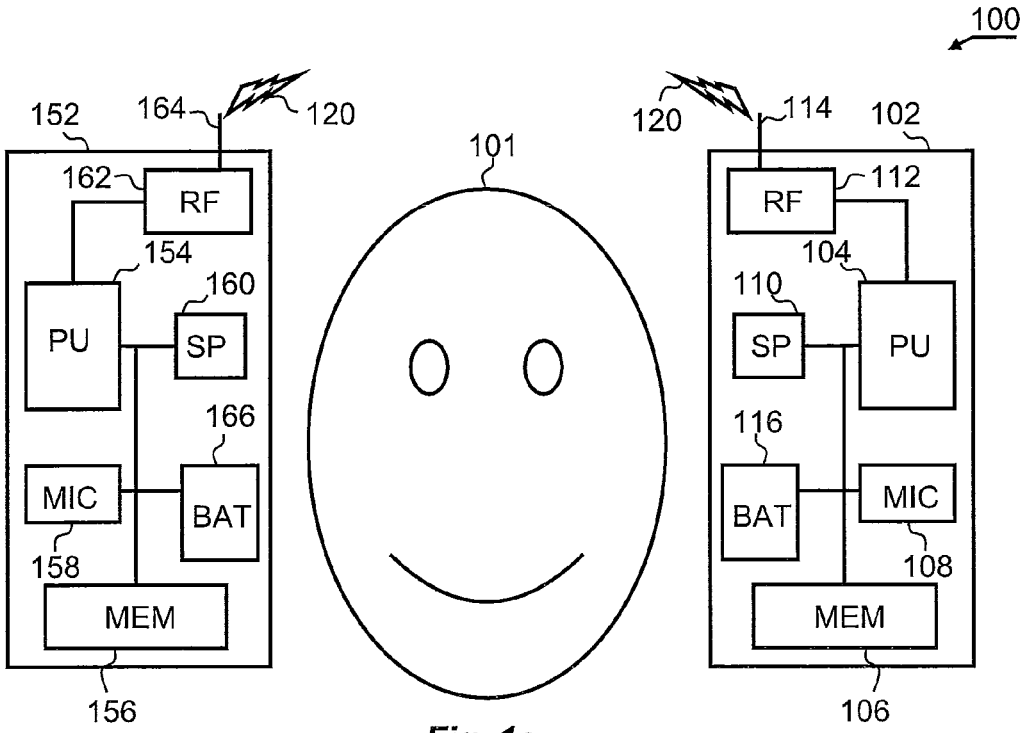
FIG. 1*a* schematically illustrates a block diagram of a binaural hearing instrument set, and FIG. 1*b* schematically illustrates allocation of memory in the binaural hearing instrument set of FIG. 1*a*.

FIG. 1*a* shows a binaural hearing instrument set, HI-set, 100 as summarized above, schematically illustrated in the form of a block diagram. The HI-set 100 is arranged close to the ears of a human user 101. The HI-set comprises a first unit 102 arranged on the left side of the user 101 (as perceived from the point of view of the user 101) and a second unit 152 arranged on the right side of the user 101. It is to be noted that the HI-set 100 may be of any type known in the art. For example, the HI-set may be any of the types BTE (behind the ear), ITE (in the ear), RITE (receiver in the ear), ITC (in the canal), MIC (mini canal) and CIC (completely in the canal). For the purpose of the presently described HI-set it is essentially irrelevant in which of these types the specifically configured circuitry is realized.

The block structure of the first and second units 102 and 152 is essentially identical, although alternative embodiments may include those where either of the units comprises additional circuitry. For the purpose of the present description, however, such differences are of no relevance.

The HI-set units 102, 152 comprise a respective processing unit 104, 154, a memory unit 106, 156, an audio input transducer 108, 158, an audio output transducer 110, 160 and radio frequency communication circuitry including a radio transceiver 112, 162 coupled to an antenna 114, 164. Electric power is provided to the circuitry by means of a battery 116, 166. Needless to say, the HI-set units 102, 152 are strictly limited in terms of physical parameters due to the fact that they are to be arranged in or close to the ears of the user 101. Hence, limitations regarding size and weight of the circuitry, not least the battery 116, 166, are important factors when constructing a hearing instrument such as the presently described HI-set 100. These limitations have implications on performance requirements on the processing unit 104, 154 as well as the memory unit 106, 156. In other words, as discussed above, it is desirable to optimize the usage of processing and memory resources in order to be able to provide a small and light weight HI-set 100.

Sound is picked up and converted to electric signals by the audio input transducer 108, 158. The electric signals from the audio input transducer 108, 158 are processed by the processing unit 104, 154 and output through the audio out put transducer 110, 160 in which the processed signals are converted from electric signals into sound. The processing unit 104, 154 processes digital data representing the sound. Conversion from analog signals into the digital data is typically performed by the processing unit 104, 154 in cooperation with the audio input transducer 108, 158.

The processing of the data takes place by means of software instructions stored in the memory unit 106, 156 and executed by the processing unit 104, 154. The software instructions are arranged such that they define one or more algorithms. Each algorithm is suitably configured to process data in order to fulfill a desired effect. The algorithms differ in complexity and their demands on processing power also vary, depending on the situation. Moreover, the algorithms allocate different amounts of temporary memory and the total amount of memory in the memory unit 106, 156 limits the number of algorithms that may execute concurrently. Some algorithms are configured to utilize data representing sound that is received by both the input transducer 108 in the first unit 102 and the input transducer in the second unit 152. Examples of such algorithms are those that provide enhanced directional information and enhanced noise suppression. In order for such algorithms to function properly, communication of data between the units 102, 152 takes place via the radio transceiver 112, 162 and the antenna 114, 164. A communication channel 120 is indicated in FIG. 1 and the skilled person will implement data communication via this channel 120 in a suitable manner, for example by using a short range radio communication protocol such as Bluetooth.

Figure 1B:
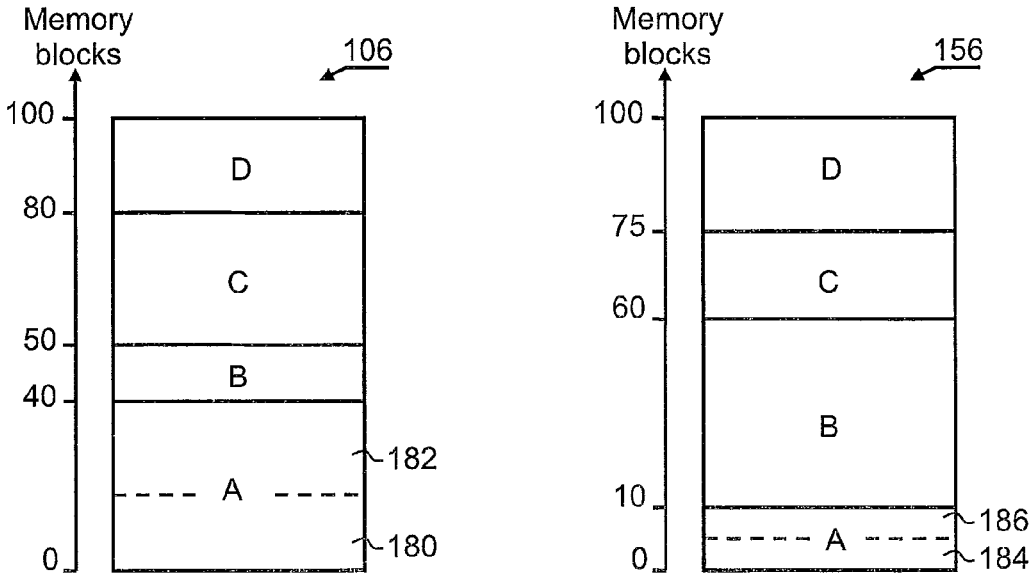

Turning now to FIG. 1*b*, allocation of memory in the memory units 106, 156 will be discussed. Each memory unit 106, 156 contains 100 blocks of memory (in arbitrary units) as indicated in the diagrams. The situation illustrated by FIG. 1*b* is one in which four different algorithms algorithm A, algorithm B, algorithm C and algorithm D have allocated a respective part of the memory 106 in the first unit 102 and the memory 156 in the second unit 152. Each algorithm A-D performs a different data processing task and the results of the processing of each algorithm A-D is required in both the first unit 102 and the second unit 152.

Each algorithm A-D is split into a respective server part and a client part. The server part of algorithm A allocates 40 blocks of the memory 106 of the first unit 102 and the client part of algorithm A allocates 10 blocks of the memory 156 of the second unit 152. A respective code part 180 and 184 illustrate an amount of memory, within the total allocated memory of algorithm A, which is used for storing the software code that implement the server part and the client part, respectively. Correspondingly, a respective scratch memory part 182 and 186 illustrates an amount of memory, within the total allocated memory of algorithm A, which is used by algorithm A as scratch memory during processing, respectively.

Similarly, the server part of algorithm B allocates 50 blocks of the memory 156 of the second unit 152 and the client part of algorithm B allocates 10 blocks of the memory 106 of the first unit 102. The server part of algorithm C allocates 30 blocks of the memory 106 of the first unit 102 and the client part of algorithm C allocates 15 blocks of the memory 156 of the second unit 152. The server part of algorithm D allocates 25 blocks of the memory 156 of the second unit 152 and the client part of algorithm B allocates 20 blocks of the memory 106 of the first unit 102.

Which of the first and second units 152, 102 is to run the server part of a particular algorithm, may be decided dynamically, i.e. during use of the HI-set 100. In this case, the software code required to run the server part and the software code required to run the client part are both stored in each unit 152, 102 in a dedicated program memory (not shown). The first and second units 152, 102 repeatedly exchange status messages comprising status information indicating the amount of free space in the memory circuitry 156, 106, the remaining battery energy and the current mode of the algorithms. When an algorithm is to be activated, the first and second units 152, 102 execute the decision by comparing their own status information with the status information received from the other unit 152, 102. If, for example, the first unit 156 is chosen to run the server part of the algorithm, e.g. because it has more free memory space and/or more remaining battery energy, then the first unit 152 copies the server mode software code of the algorithm to the memory circuitry 156 of the first unit and starts execution of the server mode software code, while the second unit 102 copies the corresponding client mode software code to the memory circuitry 106 of the second unit and starts execution of the client mode software code.

Specific algorithms may be activated and/or deactivated in response to various events occurring during use of the HI-set 100, e.g. changes of the acoustic environment or setting changes made by the user of the HI-set 100.

If one of the first and second units 152, 102 detects a failure of the communication channel 120, it switches the mode of its activated algorithms to the server mode in order to allow subsequent use of the unit 152, 102 as a stand-alone hearing instrument. In this case, algorithms pertaining to binaural hearing may be deactivated in order not to overflow the free memory space. The initial modes are restored when the unit 152, 102 detects that the communication channel 120 is functioning again.

A client mode algorithm typically requires less complex operations than the corresponding server mode algorithm and such less complex operations or computations may often be executed at a lower speed without affecting the performance of the HI-set 100. In order to reduce the total power consumption of the HI-set 100 further, each of the first and second units 152, 102 is configured to reduce the clock frequency of such portions of the processing unit 154, 156 that are currently configured to run client mode software code. Such portions may include any hardware that supports execution of the software. In the extreme case, the clock frequency of the entire unit 152, 102 may be reduced. The computation speed of the processing unit 154, 156 may additionally or alternatively be reduced by other means or methods that reduce the rate of logic transitions in the hardware. The clock frequency and/or the computation speed is increased again for such portions of the processing unit 154, 156 that are reconfigured to run server mode software code.

FIG. 1*b* illustrates clearly an advantage of the configuration of a hearing instrument set as described above. That is, the present configuration requires only 100 blocks of memory in each unit 102, 152, whereas in prior art devices algorithms A-D would need memory space corresponding to the server part of each algorithm, which would add up to a total 145 blocks of memory in each unit 102, 152.

In summary, it has been described a binaural hearing instrument set in which algorithms are split into a server part and a thin-client part. The respective server part of the algorithm is located in a first hearing instrument unit, while the thin-client part is located in a second unit in the binaural hearing instrument set.

The server part implements the actual algorithm and uses as much code-space memory as required. The server part receives input data from the thin-client part and sends results back to the thin-client part. The thin-client part transmits needed input data to the server part and receives results from the server which are used with essentially no further processing. Thereby, it uses less code-space memory as well as less temporary memory than the server part.

This results in that, as the right unit runs the algorithm in thin-client mode, it has more memory available than the left unit, providing that the same amount of physical memory is arranged in the left and the right unit. The right unit can therefore run another algorithm in server mode and use the thin-client part available in the left unit. That is, an advantage is achieved in that resources, such as memory, is saved in a resource limited hearing instrument set by distributing resource demanding algorithms between both units in the set.

The invention claimed is:

1. A binaural hearing instrument set, comprising a first unit and a second unit, each of the units comprising processing circuitry, communication circuitry and memory circuitry, wherein, the processing circuitry and the memory circuitry are configured to execute at least a first data processing algorithm, the first data processing algorithm is configured such that it comprises software code that is configured to execute in a server mode and a client mode, the first unit comprises the software code that is configured to execute in the server mode, and the second unit comprises the software code that is configured to execute in the client mode, the communication circuitry is configured to provide a communication channel between the software code that is configured to execute in the server mode in the first unit and the software code that is configured to execute in the client mode in the second unit, the processing circuitry and the memory circuitry are configured to execute a second data processing algorithm in addition to the first data processing algorithm, the second data processing algorithm is configured such that it comprises software code that is configured to execute in a server mode and a client mode, the first unit comprises the software code of the second algorithm that is executable in the client mode, and the second unit comprises the software code of the second algorithm that is executable in the server mode, the software code of the first unit that is executable in the server mode is configured to process data pertaining to the first unit and the second unit, and configured to receive data from the second unit and transmit processed data to the second unit, the software code of the second unit that is executable in the client mode is configured to transmit data to the first unit and receive processed data from the first unit, the first unit and the second unit comprise respective audio input transducers and respective audio output transducers, the software code of the first unit is configured to receive audio input data from the input transducer in the first unit, process the audio data from the input transducer in the first unit and output processed audio data to the audio output transducer in the first unit, the software code of the first unit is configured to receive audio data from the second unit, process the received audio data and transmit processed audio data to the second unit, and the software code of the second unit is configured receive audio input data from the input transducer in the second unit, transmit the audio data from the input transducer in the second unit, receive processed audio data from the first unit, and output the processed audio data to the audio output transducer in the second unit.

2. The binaural hearing instrument set of claim 1, wherein the software code of the first unit that is executable in the server mode is configured to execute a major part of the data processing algorithm, and the software code of the second unit that is executable in the client mode is configured to execute a minor part of the data processing algorithm.

3. The binaural hearing instrument set of claim 1 or 2, wherein the software code of the first unit that is executable in the server mode is configured such that it has a server code size, and the software code of the second unit that is executable in the client mode is configured such that it has a client code size that is smaller than the server code size.

4. The binaural hearing instrument set of claim 1, wherein the software code of the first unit that is executable in the server mode is configured to utilize a first amount of memory during execution, and the software code of the second unit that is executable in the client mode is configured to utilize a second amount of memory during execution, the second amount of memory being smaller than the first amount of memory.

5. The binaural hearing instrument set of claim 1, wherein the first and the second data processing algorithms are identical, and the hearing instrument set is configured to selectively activate or deactivate execution of the first data processing algorithm and to deactivate execution of the second data processing algorithm when execution of the first data processing algorithm is activated.

6. The binaural hearing instrument set of claim 5, wherein the first unit is configured to activate execution of the first data processing algorithm in response to detecting a failure of the communication channel.

7. The binaural hearing instrument set of claim 5, wherein:

the processing circuitry and the memory circuitry of the second unit are configured to execute a third data processing algorithm, the second unit is configured to selectively activate or deactivate execution of the third data processing algorithm and to transmit one or more status messages to the first unit, the status messages indicating the activation of the execution of the third data processing algorithm, and the first unit is configured to activate execution of the first data processing algorithm in response to the status messages.

8. The binaural hearing instrument set of claim 5, wherein the first unit is configured to reduce a clock frequency and/or a computation speed of the processing circuitry in the first unit in response to deactivating execution of the first data processing algorithm.

* * * * *